US011810544B2

(12) United States Patent
Steele

(10) Patent No.: US 11,810,544 B2
(45) **Date of Patent: *Nov. 7, 2023**

(54) SYSTEMS AND METHODS FOR ON EAR DETECTION OF HEADSETS

(71) Applicant: Cirrus Logic International Semiconductor Ltd., Edinburgh (GB)

(72) Inventor: Brenton Steele, Blackburn South (AU)

(73) Assignee: Cirrus Logic Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/705,974

(22) Filed: Mar. 28, 2022

(65) Prior Publication Data

US 2022/0223137 A1 Jul. 14, 2022

Related U.S. Application Data

(63) Continuation of application No. 16/777,016, filed on Jan. 30, 2020, now Pat. No. 11,322,131.

(51) Int. Cl.
*G10K 11/178* (2006.01)
*H04R 3/00* (2006.01)

(52) U.S. Cl.
CPC ..... *G10K 11/17881* (2018.01); *H04R 3/002* (2013.01); *H04R 3/007* (2013.01); *G10K 2210/1081* (2013.01); *G10K 2210/3028* (2013.01); *G10K 2210/3226* (2013.01)

(58) Field of Classification Search
CPC ..... H04R 1/1016; H04R 2460/13; H04R 1/1041; H04R 29/001; H04R 3/00; G10K 11/178
USPC ..... 381/71.6, 71.7, 71.8, 376, 380, 381
See application file for complete search history.

(56) References Cited

U.S. PATENT DOCUMENTS

| | | | | |
|---|---|---|---|---|
| 10,231,047 | B2 | 3/2019 | Kumar et al. | |
| 10,448,140 | B2 | 10/2019 | Kumar et al. | |
| 2014/0037101 | A1* | 2/2014 | Murata | H04R 1/1041 381/74 |
| 2016/0078881 | A1* | 3/2016 | Shin | G10L 21/038 381/74 |

(Continued)

*Primary Examiner* — Yosef K Laekemariam
(74) *Attorney, Agent, or Firm* — Jackson Walker L.L.P

(57) ABSTRACT

Embodiments generally relate to a signal processing device for on ear detection for a headset. The device comprises a first microphone input for receiving a microphone signal from a first microphone, the first microphone being configured to be positioned inside an ear of a user when the user is wearing the headset; a second microphone input for receiving a microphone signal from a second microphone, the second microphone being configured to be positioned outside the ear of the user when the user is wearing the headset; and a processor. The processor is configured to receive microphone signals from each of the first microphone input and the second microphone input; pass the microphone signals through a first filter to remove low frequency components, producing first filtered microphone signals; combine the first filtered microphone signals to determine a first on ear status metric; pass the microphone signals through a second filter to remove high frequency components, producing second filtered microphone signals; combine the second filtered microphone signals to determine a second on ear status metric; and combine the first on ear status metric with the second on ear status metric to determine the on ear status of the headset.

20 Claims, 8 Drawing Sheets

(56) References Cited

U.S. PATENT DOCUMENTS

2019/0110120 A1* 4/2019 Sapozhnykov .. G10K 11/17815
2020/0014996 A1* 1/2020 Kumari ..... H04R 1/1041

* cited by examiner

SYSTEMS AND METHODS FOR ON EAR DETECTION OF HEADSETS

This application is a continuation of U.S. patent application Ser. No. 16/777,016, filed Jan. 30, 2020, which is incorporated by reference herein in its entirety.

TECHNICAL FIELD

Embodiments generally relate to systems and methods for determining whether or not a headset is located on or in an ear of a user, and to headsets configured to determine whether or not the headset is located on or in an ear of a user.

BACKGROUND

Headsets are a popular device for delivering sound and audio to one or both ears of a user. For example, headsets may be used to deliver audio such as playback of music, audio files or telephony signals. Headsets typically also capture sound from the surrounding environment. For example, headsets may capture the user's voice for voice recording or telephony, or may capture background noise signals to be used to enhance signal processing by the device. Headsets can provide a wide range of signal processing functions.

For example, one such function is Active Noise Cancellation (ANC, also known as active noise control) which combines a noise cancelling signal with a playback signal and outputs the combined signal via a speaker, so that the noise cancelling signal component acoustically cancels ambient noise and the user only or primarily hears the playback signal of interest. ANC processing typically takes as inputs an ambient noise signal provided by a reference (feed-forward) microphone, and a playback signal provided by an error (feed-back) microphone. ANC processing consumes appreciable power continuously, even if the headset is taken off.

Thus in ANC, and similarly in many other signal processing functions of a headset, it is desirable to have knowledge of whether the headset is being worn at any particular time. For example, it is desirable to know whether on-ear headsets are placed on or over the pinna(e) of the user, and whether earbud headsets have been placed within the ear canal(s) or concha(e) of the user. Both such use cases are referred to herein as the respective headset being "on ear". The unused state, such as when a headset is carried around the user's neck or removed entirely, is referred to herein as being "off ear".

Previous approaches to on ear detection include the use of a sense microphone positioned to detect acoustic sound inside the headset when worn, on the basis that acoustic reverberation inside the ear canal and/or pinna will cause a detectable rise in power of the sense microphone signal as compared to when the headset is not on ear. However, the sense microphone signal power can be affected by noise sources such as the user's own voice, and so this approach can output a false negative that the headset is off ear when in fact the headset is on ear and affected by bone conducted own voice.

It is desired to address or ameliorate one or more shortcomings or disadvantages associated with prior systems and methods for determining whether or not a headset is in place on or in the ear of a user, or to at least provide a useful alternative thereto.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this document, a statement that an element may be "at least one of" a list of options is to be understood to mean that the element may be any one of the listed options, or may be any combination of two or more of the listed options.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY

Some embodiments relate to a signal processing device for on ear detection for a headset, the device comprising:

- a first microphone input for receiving a microphone signal from a first microphone, the first microphone being configured to be positioned inside an ear of a user when the user is wearing the headset;
- a second microphone input for receiving a microphone signal from a second microphone, the second microphone being configured to be positioned outside the ear of the user when the user is wearing the headset; and
- a processor configured to:
  - receive microphone signals from each of the first microphone input and the second microphone input;
  - pass the microphone signals through a first filter to remove low frequency components, producing first filtered microphone signals;
  - combine the first filtered microphone signals to determine a first on ear status metric;
  - pass the microphone signals through a second filter to remove high frequency components, producing second filtered microphone signals;
  - combine the second filtered microphone signals to determine a second on ear status metric; and
  - combine the first on ear status metric with the second on ear status metric to determine the on ear status of the headset.

According to some embodiments, the first filter is configured to filter the microphone signals to retain only frequencies that are likely to correlate to bone conducted speech of the user of the headset. In some embodiments, the first filter is a band pass filter. In some embodiments, the first filter is a bandpass filter configured to filter the microphone signals to frequencies between 2.8 and 4.7 kHz.

According to some embodiments, the second filter is configured to filter the microphone signals to retain only frequencies that are likely to resonate within the ear of the user. In some embodiments, the second filter is a band pass filter. In some embodiments, the second filter is configured to filter the microphone signals to frequencies between 100 and 600 Hz.

In some embodiments, combining the first filtered signals comprises subtracting the first filtered signal derived from the microphone signal received from the second microphone from the first filtered signal derived from the microphone signal received from the first microphone.

According to some embodiments, combining the second filtered signals comprises subtracting the second filtered signal derived from the microphone signal received from the first microphone from the second filtered signal derived from the microphone signal received from the second microphone.

According to some embodiment, combining the first on ear status metric with the second on ear status metric comprises adding the metrics together, and comparing the result with a predetermined threshold. In some embodiments, the predetermined threshold is between 6 dB and 10 dB. According to some embodiments, the predetermined threshold is 8 dB.

Some embodiments relate to a method of on ear detection for an earbud, the method comprising:

receiving microphone signals from each of a first microphone and a second microphone, wherein the first microphone is configured to be positioned inside an ear of a user when the user is wearing the earbud and the second microphone is configured to be positioned outside the ear of the user when the user is wearing the earbud;

passing the microphone signals through a first filter to remove low frequency components, producing first filtered microphone signals;

combining the first filtered microphone signals to determine a first on ear status value;

passing the microphone signals through a second filter to remove high frequency components, producing second filtered microphone signals;

combining the second filtered microphone signals to determine a second on ear status value; and combining the first on ear status value with the second on ear status value to determine the on ear status of the headset.

According to some embodiments, the first filter is configured to filter the microphone signals to retain only frequencies that are likely to correlate to bone conducted speech of the user of the headset. In some embodiments, the first filter is a band pass filter. In some embodiments, the first filter is a band-pass filter configured to filter the microphone signals to frequencies between 100 and 600 Hz.

According to some embodiments, the second filter is configured to filter the microphone signals to retain only frequencies that are likely to resonate within the ear of the user. In some embodiments, the second filter is a band pass filter. According to some embodiments, the second filter is configured to filter the microphone signals to frequencies between 2.8 and 4.7 kHz.

According to some embodiments, combining the first filtered signals comprises subtracting the first filtered signal derived from the microphone signal received from the second microphone from the first filtered signal derived from the microphone signal received from the first microphone.

In some embodiments, combining the second filtered signals comprises subtracting the second filtered signal derived from the microphone signal received from the first microphone from the second filtered signal derived from the microphone signal received from the second microphone.

In some embodiments, combining the first on ear status metric with the second on ear status metric comprises adding the metrics together to produce a passive OED metric, and comparing the passive OED metric with a predetermined threshold. According to some embodiments, the predetermined threshold is between 6 dB and 10 dB. In some embodiments, the predetermined threshold is 8 dB.

Some embodiments further comprise incrementing an on ear variable if the passive OED metric exceeds the threshold, and incrementing an off ear variable if the passive OED metric does not exceed the threshold. Some embodiments further comprise determining that the status of the earbud is on ear if the on ear variable value is larger than a first predetermined threshold and the off ear variable value is smaller than a second predetermined threshold; determining that the status of the earbud is off ear if the off ear variable value is larger than the first predetermined threshold and the on ear variable value is smaller than the second predetermined threshold; and otherwise determining that the status of the earbud is unknown.

Some embodiments further comprise determining whether the microphone signals correspond to valid data, by comparing the power level of the microphone signals received from the second microphone exceed a predetermined threshold. In some embodiments, the threshold is 60 dB SPL.

Some embodiments relate to a non-transitory machine-readable medium storing instructions which, when executed by one or more processors, cause an electronic apparatus to perform the method of some other embodiments.

Some embodiments relate to an apparatus, comprising processing circuitry and a non-transitory machine-readable which, when executed by the processing circuitry, cause the apparatus to perform the method of some other embodiments.

Some embodiments relate to a system for on ear detection for an earbud, the system comprising a processor and a memory, the memory containing instructions executable by the processor and wherein the system is operative to perform the method of some other embodiments.

BRIEF DESCRIPTION OF DRAWINGS

Embodiments are described in further detail below, by way of example and with reference to the accompanying drawings, in which.

DETAILED DESCRIPTION

Embodiments generally relate to systems and methods for determining whether or not a headset is located on or in an ear of a user, and to headsets configured to determine whether or not the headset is located on or in an ear of a user.

Some embodiments relate to a passive on ear detection technique that reduces, or mitigates the likelihood of, false negative results that may arise from an earbud detecting the user's own voice via bone conduction, by filtering signals received from internal and external microphones by two different filters and comparing these in parallel, with the results of each comparison being added to result in a final on ear status being determined.

Specifically, some embodiments relate to a passive on ear detection technique that uses a first algorithm to filter the internal and external microphones to a band that excludes most bone conducted speech, which tends to be of a lower frequency, and to determine whether the external microphone senses louder sounds than the internal microphone. In parallel, the technique uses a second algorithm to filter the internal and external microphones to a band that would include most bone conducted speech, and determines whether bone conduction exists by determining whether the internal microphone senses louder sounds than the external microphone. The outcomes of the first and second algorithms are combined to determine the on ear status of the earbud.

As bone conduction only occurs when an earphone is located inside an ear, this technique allows for the on ear status of the earbud to be determined regardless of whether own voice is present or not.

Figure 1:
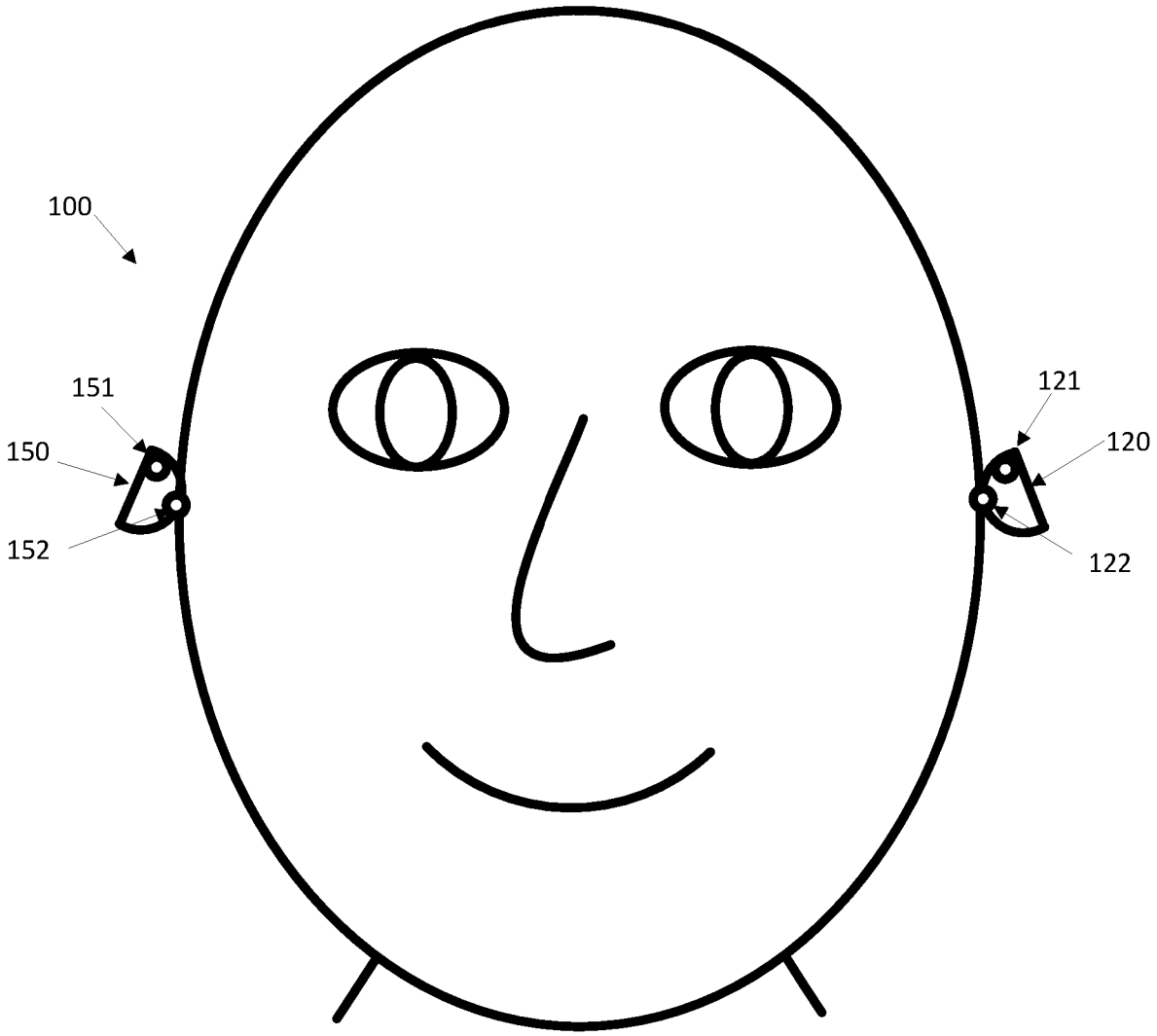
FIG. 1 illustrates a signal processing system comprising a headset in which on ear detection is implemented according to some embodiments.

FIG. 1 illustratea a headset 100 in which on ear detection is implemented. Headset 100 comprises two earbuds 120 and 150, each comprising two microphones 121, 122 and 151, 152, respectively. Headset 100 may be configured to determine whether or not each earbud 120, 150 is located in or on an ear of a user.

Figure 2:
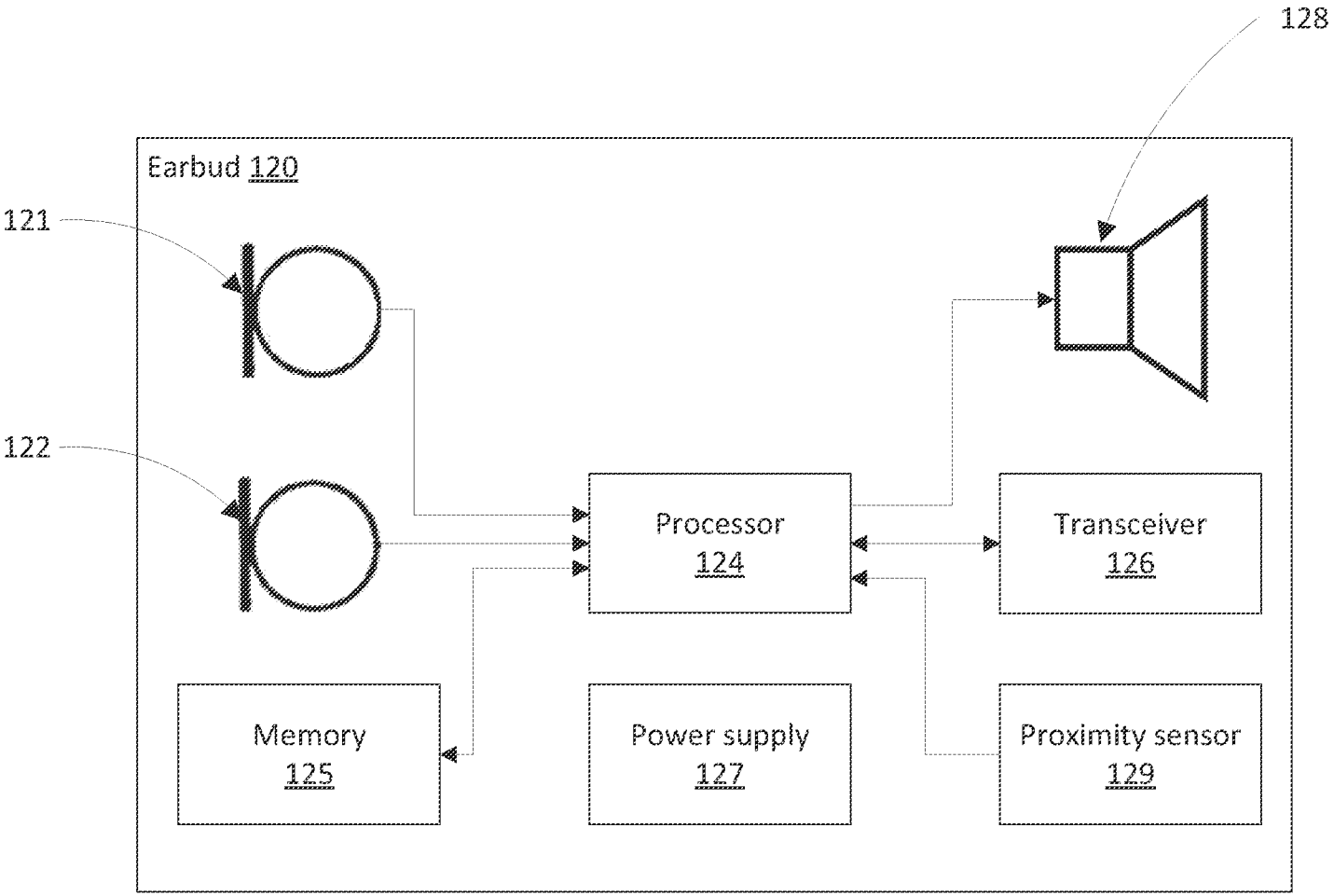
FIG. 2 shows a block diagram illustrating the hardware components of an earbud of the headset of FIG. 1 according to some embodiments.

FIG. 2 is a system schematic showing the hardware components of earbud 120 in further detail. Earbud 150 comprises substantially the same components as earbud 120, and is configured in substantially the same way. Earbud 150 is thus not separately shown or described.

As well as microphones 121 and 122, earbud 120 comprises a digital signal processor 124 configured to receive microphone signals from earbud microphones 121 and 122. Microphone 121 is an external or reference microphone and is positioned to sense ambient noise from outside the ear canal and outside of the earbud when earbud 120 is positioned in or on an ear of a user. Conversely, microphone 122 is an internal or error microphone and is positioned inside the ear canal so as to sense acoustic sound within the ear canal when earbud 120 is positioned in or on an ear of the user.

Earbud 120 further comprises a speaker 128 to deliver audio to the ear canal of the user when earbud 120 is positioned in or on an ear of a user. When earbud 120 is positioned within the ear canal, microphone 122 is occluded to at least some extent from the external ambient acoustic environment, but remains well coupled to the output of speaker 128. In contrast, microphone 121 is occluded to at least some extent from the output of speaker 128 when earbud 120 is positioned in or on an ear of a user, but remains well coupled to the external ambient acoustic environment. Headset 100 may be configured to deliver music or audio to a user, to allow a user to make telephone calls, and to deliver voice commands to a voice recognition system, and other such audio processing functions.

Processor 124 is further configured to adapt the handling of such audio processing functions in response to one or both earbuds 120, 150 being positioned on the ear, or being removed from the ear. For example, processor 124 may be configured to pause audio being played through headset 100 when processor 124 detects that one or more earbuds 120, 150 have been removed from a user's ear(s). Processor 124 may be further configured to resume audio being played through headset 100 when processor 124 detects that one or more earbuds 120, 150 have been placed on or in a user's ear(s).

Earbud 120 further comprises a memory 125, which may in practice be provided as a single component or as multiple components. The memory 125 is provided for storing data and program instructions readable and executable by processor 124, to cause processor 124 to perform functions such as those described above.

Earbud 120 further comprises a transceiver 126, which allows the earbud 120 to communicate with external devices. According to some embodiments, earbuds 120, 150 may be wireless earbuds, and transceiver 126 may facilitate wireless communication between earbud 120 and earbud 150, and between earbuds 120, 150 and an external device such as a music player or smart phone. According to some embodiments, earbuds 120, 150 may be wired earbuds, and transceiver 126 may facilitate wired communications between earbud 120 and earbud 150, either directly such as within an overhead band, or via an intermediate device such as a smartphone. According to some embodiments, earbud 120 may further comprise a proximity sensor 129 configured to send signals to processor 124 indicating whether earbud 120 is located in proximity to an object, and/or to measure the proximity of the object. Proximity sensor 129 may be an infrared sensor or an infrasonic sensor in some embodiments. According to some embodiments, earbud 120 may have other sensors, such as movement sensors or accelerometers, for example. Earbud 120 further comprises a power supply 127, which may be a battery according to some embodiments.

Figure 3:
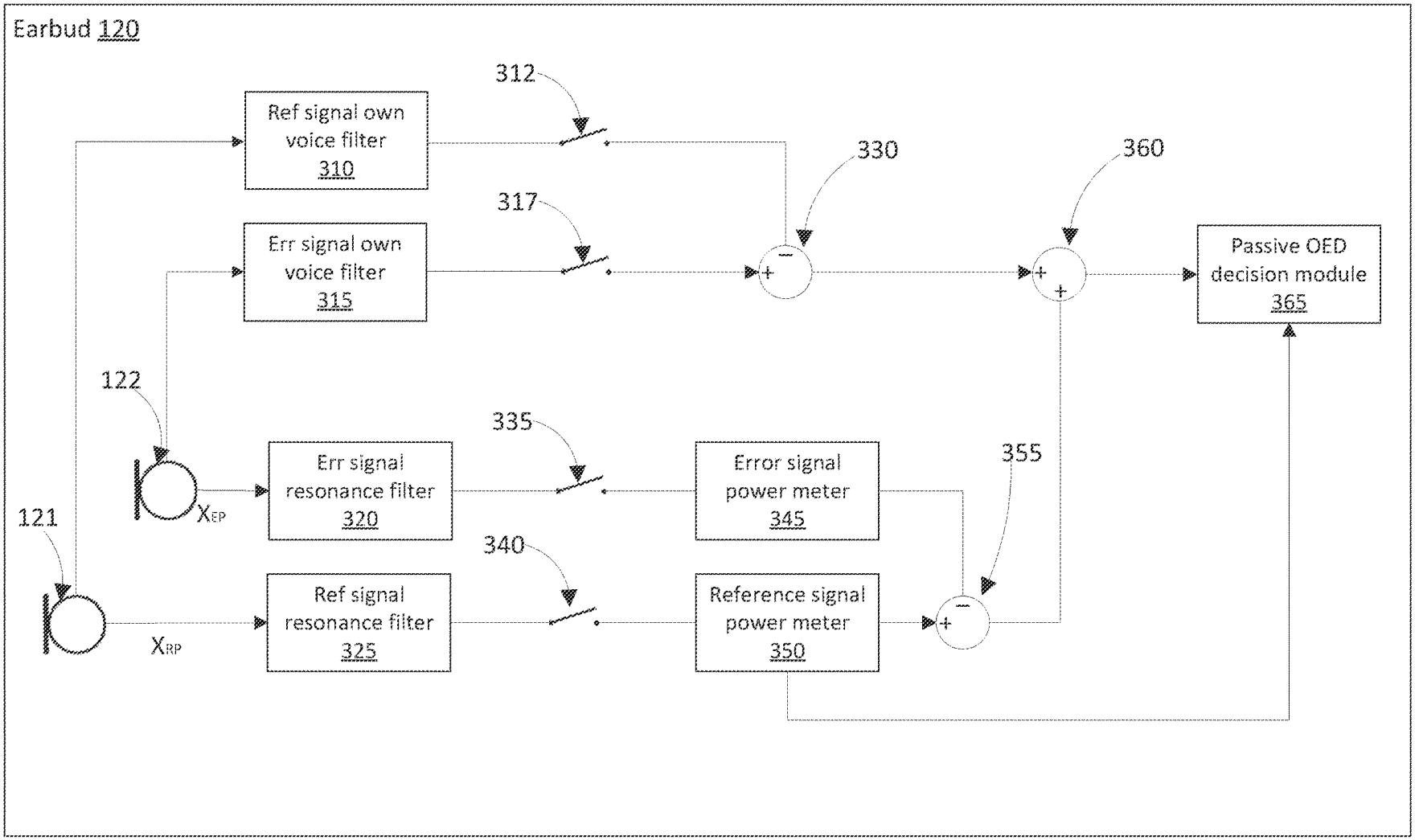
FIG. 3 shows a block diagram illustrating the earbud of FIG. 2 in further detail according to some embodiments.

FIG. 3 is a block diagram showing earbud 120 in further detail, and illustrating a process of passive on ear detection in accordance with some embodiments. FIG. 3 shows microphones 121 and 122. Reference microphone 121 generates passive signal $X_{RP}$ based on detected ambient sounds when no audio is being played via speaker 128. Error microphone 122 generates passive signal $X_{EP}$ based on detected ambient sounds when no audio is being played via speaker 128.

Reference signal own voice filter 310 is configured to filter the passive signal $X_{RP}$ generated by reference microphone 121 to frequencies that are likely to correlate to bone conducted user's speech or own voice. According to some embodiments, filter 310 may be configured to filter the passive signal $X_{RP}$ to frequencies between 100 and 600 Hz. According to some embodiments, filter 310 may be a $4^{th}$ order infinite impulse response (IIR) filter. Error signal own voice filter 315 is configured to filter the passive signal $X_{EP}$ generated by error microphone 122 to frequencies that are likely to correlate to bone conducted user's speech or own voice. According to some embodiments, filter 315 may be configured with the same parameters as filter 310. According to some embodiments, filter 315 may be configured to filter the passive signal $X_{EP}$ to frequencies between 100 and 600 Hz. According to some embodiments, filter 315 may be a $4^{th}$ order infinite impulse response (IIR) filter.

In order to avoid analysing unstable signals and as the output of band pass filters 310 and 315 may take a while to stabilise, the outputs of filters 310 and 315 may be passed through hold-off switches 312 and 317. Switches 312 and 317 may be configured to close after a predetermined time period has elapsed after receiving a signal via microphones 121 or 122. According to some embodiments, the predetermined time period may be between 10 ms and 60 ms. According to some embodiments, the predetermined time period may be around 40 ms.

Once the hold-off switches 312 and 317 have closed, the output of filter 310 may be subtracted from the output of filter 315 by subtraction node 330 to generate an own voice OED metric. As own voice is likely to be louder in ear than out of ear due to bone conduction, a positive own voice OED metric is likely to be generated when earbud 120 is located in or on an ear of a user, and a negative own voice OED metric is likely to be generated when earbud 120 is off the ear of the user.

Error signal resonance filter 320 is configured to filter the passive signal $X_{EP}$ generated by error microphone 122 to frequencies that are likely to resonate within the user's ear. According to some embodiments, these may also be frequencies that are unlikely to correlate to the user's speech or own voice. According to some embodiments, filter 320 may be configured to filter the passive signal $X_{EP}$ to frequencies between 2.8 and 4.7 kHz. According to some embodiments, filter 320 may be a 6th order infinite impulse response (IIR) filter. Reference signal resonance filter 325 is configured to filter the passive signal $X_{RP}$ generated by reference microphone 121 to frequencies that are likely to resonate within the user's ear. According to some embodiments, these may also be frequencies that are unlikely to correlate to the user's speech or own voice. According to some embodiments, filter 325 may be configured with the same parameters as filter 320. According to some embodiments, filter 325 may be configured to filter the passive signal $X_{RP}$ to frequencies between 2.8 and 4.7 kHz. According to some embodiments, filter 325 may be a 6th order infinite impulse response (IIR) filter.

In order to avoid analysing unstable signals and as the output of band pass filters 320 and 325 may take a while to stabilise, the outputs of filters 320 and 325 may be passed through hold-off switches 335 and 340. Switches 335 and 340 may be configured to close after a predetermined time period has elapsed after receiving a signal via microphones 121 or 122. According to some embodiments, the predetermined time period may be between 10 ms and 60 ms. According to some embodiments, the predetermined time period may be around 40 ms.

Once the hold-off switches 335 and 340 have closed, the outputs of filters 320 and 325 are passed to power meters 345 and 350. Error signal power meter 345 determines the power of the filtered output of filter 320, while reference signal power meter 350 determines the power of the filtered output of filter 325. The reference signal power determined by meter 350 is passed to passive OED decision module 365 for analysis. According to some embodiments, in order to further avoid instability in the data, power meters 345 and 350 may be primed to a predetermined power level, so that the power of the filtered signals can be more quickly determined. According to some embodiments, power meters 345 and 350 may be primed to start at a power threshold, which may be between 50 and 80 dB SPL in some embodiments. According to some embodiments, the power threshold may be 60 to 70 dB SPL.

The error signal power as determined by meter 345 is then subtracted from the reference signal power as determined by meter 350 at subtraction node 355 to generate a passive loss OED metric. As ambient noise is likely to be louder out of ear than in ear due to obstruction of error microphone 122 when earbud 120 is in ear, a large degree of attenuation or passive loss is likely to be generated when earbud 120 is located in or on an ear of a user, and a passive loss close to zero is likely to be generated when earbud 120 is off the ear of the user.

The own voice OED metric generated by node 330 and the passive loss OED metric generated by node 355 are both passed to addition node 360. Addition node 360 adds the two metrics together to produce a passive OED metric, which is passed to passive OED decision module 365 for analysis. The decision process performed by OED decision module 365 is described in further detail below with reference to FIG. 4.

Figure 4:
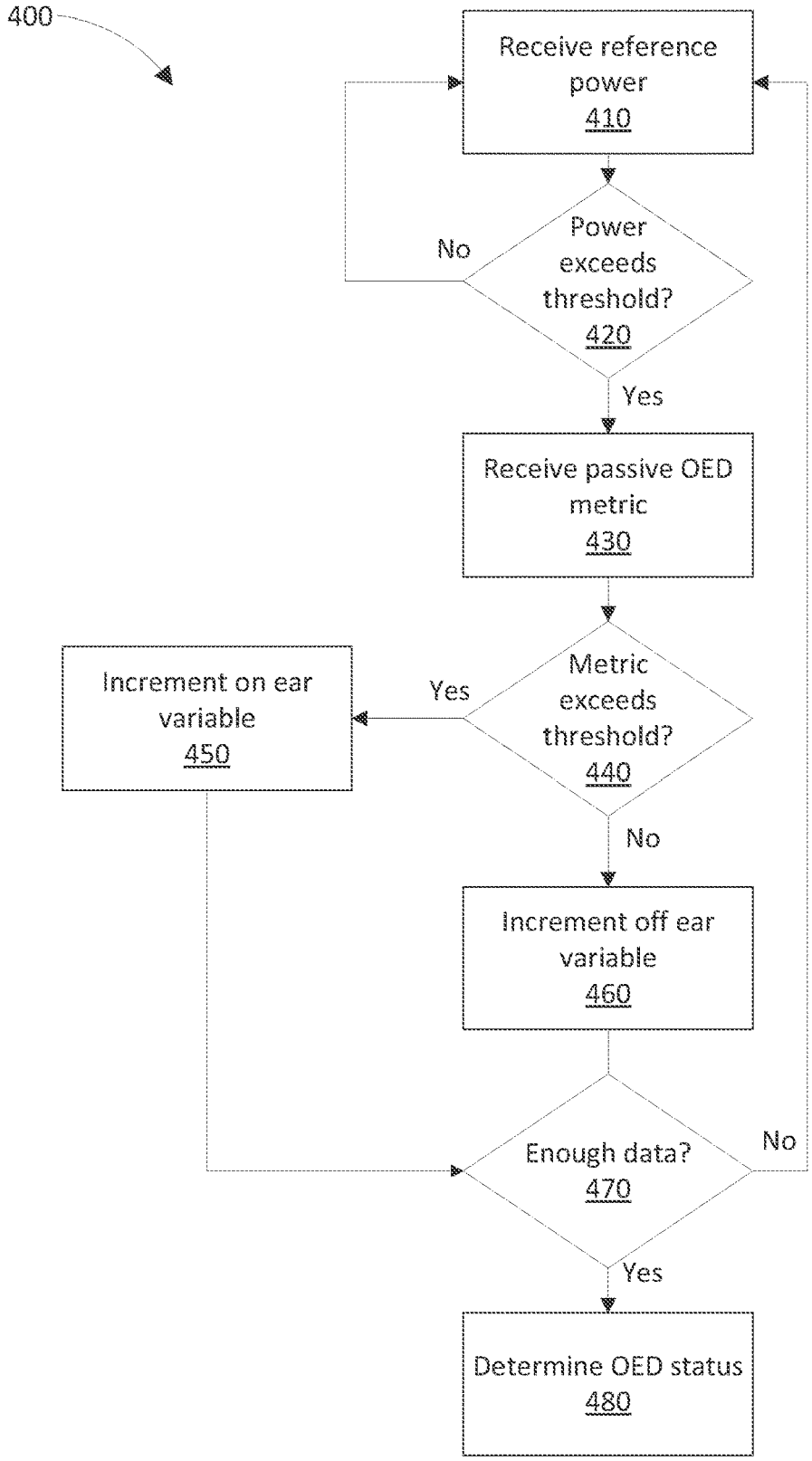
FIG. 4 shows a block diagram showing a passive on ear detection process performed by the earbud of FIG. 2 according to some embodiments.

FIG. 4 is a flowchart illustrating a method 400 of passive on ear detection using earbud 120. Method 400 is performed by processor 124 executing passive OED decision module 365 stored in memory 125.

Method 400 starts at step 410, at which a reference signal power calculated by reference signal power meter 350 is received by passive OED decision module 365. At step 420, processor 124 determines whether or not the reference signal power exceeds a predetermined power threshold, which may be between 50 and 80 dB SPL in some embodiments. According to some embodiment, the power threshold may be 60 to 70 dB SPL.

If the power does not exceed the threshold, this indicates that the data is invalid, as there are not enough sounds captured by reference microphone 121 to make an accurate OED determination. Processor 124 causes method 400 to restart at step 410, waiting for further data to be received. If the power does exceed the threshold, processor 124 determines that the data is valid and continues executing method 400 at step 430.

At step 430, the passive OED metric determined by node 360 is received by passive OED decision module 365. At step 440, processor 124 determines whether or not the metric exceeds a predetermined threshold, which may be between 6 dB and 10 dB, and may be 8 dB according to some embodiments. If processor 124 determines that the metric does exceed the threshold, indicating that earbud 120 is likely to be on or in the ear of a user, an "on ear" variable is incremented by processor 124 at step 450. If processor 124 determines that the metric does not exceed the threshold, indicating that earbud 120 is likely to be off the ear of a user, an "off ear" variable is incremented by processor 124 at step 460.

Method 400 then moves to step 470, at which processor 124 determines whether enough data has been received. According to some embodiments, processor 124 may make this determination by incrementing a counter, and determining if the counter exceeds a predetermined threshold. For example, the predetermined threshold may be between 100 and 500, and may be 250 in some embodiments. If processor 124 determines that enough data has not been received, such as by determining that the threshold has not been reached, processor 124 may continue executing method 400 from step 410, waiting for further data to be received. According to some embodiments, data may be received at regular intervals. According to some embodiments, the regular intervals may be intervals of 4 ms.

If processor 124 determines that enough data has been received, such as by determining that the threshold has been reached, processor 124 may continue executing method 400 from step 480. According to some embodiments, processor 124 may also be configured to execute a time out process, where if enough data is not received within a predefined time period, processor 124 continues executing method 400 from step 480 once the predetermined time has elapsed. According to some embodiments, in this case processor 124 may determine that the OED status is unknown.

At step 480, processor 124 may determine the OED status based on the on ear and off ear variables. According to some embodiments, if the on ear variable exceeds a first threshold and the off ear variable is less than a second variable, processor 124 may determine that earbud 120 is on or in the ear of a user. If the off ear variable exceeds the first threshold and the on ear variable is less than the second variable, processor 124 may determine that earbud 120 is off the ear of a user. If neither of these criteria are met, processor 124 may determine that the on ear status of earbud 120 is unknown. According to some embodiments, the first threshold may be between 50 and 200, and may be 100 according to some embodiments. According to some embodiments, the second threshold may be between 10 and 100, and may be 50 according to some embodiments.

According to some embodiments, the method of FIG. 4 may be executed as part of a broader process for on ear detection, as described below with reference to FIGS. 5 and 6.

Figure 5:
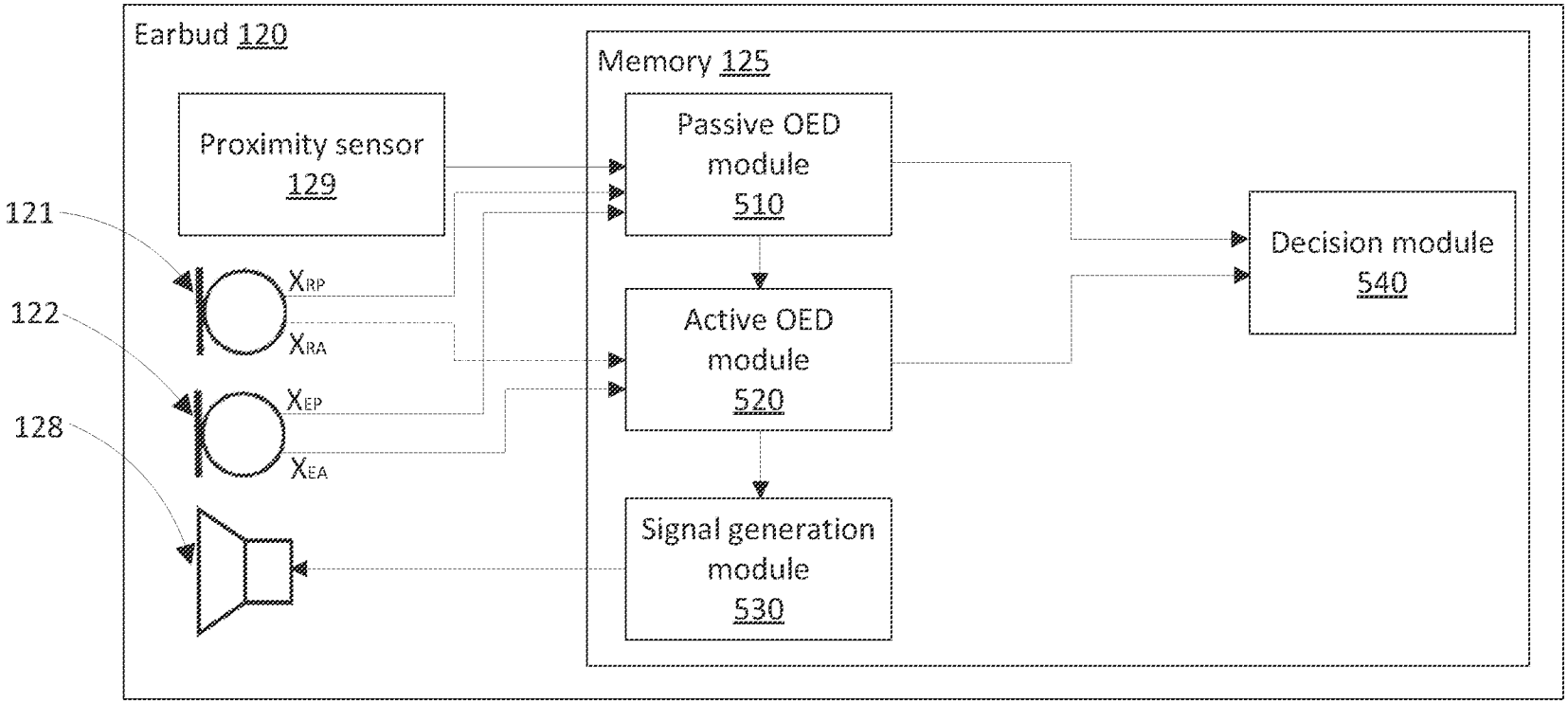
FIG. 5 shows a block diagram showing the software modules of the earbud of the headset of FIG. 1.

FIG. 5 is a block diagram showing executable software modules stored in memory 125 of earbud 120 in further detail, and further illustrating a process for on ear detection in accordance with some embodiments. FIG. 5 shows microphones 121 and 122, as well as speaker 128 and proximity sensor 129. Proximity sensor 129 may be an optional component in some embodiments. Reference microphone 121 generates passive signal $X_{RP}$ based on detected ambient sounds when no audio is being played via speaker 128. When audio is being played via speaker 128, reference microphone 121 generates active signal $X_{RA}$ based on detected sounds, which may include ambient sounds as well as sounds emitted by speaker 128. Error microphone 122 generates passive signal $X_{EP}$ based on detected ambient sounds when no audio is being played via speaker 128. When audio is being played via speaker 128, error microphone 122 generates active signal $X_{EA}$ based on detected sounds, which may include ambient sounds as well as sounds emitted by speaker 128.

Memory 125 stores passive on ear detection module 510 executable by processor 124 to use passive on ear detection to determine whether or not earbud 120 is located on or in an ear of a user. Passive on ear detection refers to an on ear detection process that does not require audio to be emitted via speaker 128, but instead uses the sounds detected in the ambient acoustic environment to make an on ear determination, such as the process described above with reference to FIGS. 3 and 4. Module 510 is configured to receive signals from proximity sensor 129, as well as passive signals $X_{RP}$ and $X_{EP}$ from microphones 121 and 122. The signal received from proximity sensor 129 may indicate whether or not earbud 120 is in proximity to an object. If the signal received from proximity sensor 129 indicates that earbud 120 is in proximity to an object, passive on ear detection module 510 may be configured to cause processor 124 to process passive signals $X_{RP}$ and $X_{EP}$ to determine whether earbud 120 is located in or on an ear of a user. According to some embodiments where earbud 120 does not comprise a proximity sensor 129, earbud 120 may instead perform passive on ear detection constantly or periodically based on a predetermined time period, or based on some other input signal being received.

Processor 124 may perform passive on ear detection by performing method 400 as described above with reference to FIGS. 3 and 4.

If a determination cannot be made by passive on ear detection module 510, passive on ear detection module 510 may send a signal to active on ear detection module 520 to indicate that passive on ear detection was unsuccessful. According to some embodiments, even where passive on ear detection module 510 can make a determination, passive on ear detection module 510 may send a signal to active on ear detection module 520 to initiate active on ear detection, which may be used to confirm the determination made by passive on ear detection module 510, for example.

Active on ear detection module 520 may be executable by processor 124 to use active on ear detection to determine whether or not earbud 120 is located on or in an ear of a user. Active on ear detection refers to an on ear detection process that requires audio to be emitted via speaker 128 to make an on ear determination. Module 520 may be configured to cause speaker 128 to play a sound, to receive active signal $X_{EA}$ from error microphone 122 in response to the played sound, and to cause processor 124 to process active signal $X_{EA}$ with reference to the played sound to determine whether earbud 120 is located in or on an ear of a user. According to some embodiments, module 520 may also optionally receive and process active signal $X_{RA}$ from reference microphone 121.

Processor 124 executing active on ear detection module 520 may first be configured to instruct signal generation module 530 to generate a probe signal to be emitted by speaker 128. According to some embodiments, the generated probe signal may be an audible probe signal, and may be a chime signal, for example. According to some embodiments, the probe signal may be a signal of a frequency known to resonate in the human ear canal. For example, according to some embodiments, the signal may be of a frequency between 100 Hz and 2 kHz. According to some embodiments, the signal may be of a frequency between 200 and 400 Hz. According to some embodiments, the signal may comprise the notes C, D and G, being a Csus2 chord.

Microphone 122 may generate active signal $X_{EA}$ during the period that speaker 128 is emitting the probe signal. Active signal $X_{EA}$ may comprise a signal corresponding at least partially to the probe signal emitted by speaker 128.

Once speaker 128 has emitted the signal generated by signal generation module 530, and microphone 122 has generated active signal $X_{EA}$, being the signal generated based on audio sensed by microphone 122 during the emission of the generated signal by speaker 128, signal $X_{EA}$ is processed by processor 124 executing active on ear detection module 520 to determine whether earbud 120 is on or in an ear of a user. Processor 124 may perform active on ear detection by detecting whether or not error microphone 122 detected resonance of the probe signal emitted by speaker 128, by comparing the probe signal with active signal $X_{EA}$. This may comprise determining whether a resonance gain of the detected signal exceeds a predetermined threshold. If processor 124 determines that active signal $X_{EA}$ correlates with resonance of the probe signal, processor 124 may determine that microphone 122 is located within an ear canal of a user, and that earbud 120 is therefore located on or in an ear of a user. If processor 124 determines that active signal $X_{EA}$ does not correlate with resonance of the probe signal, processor 124 may determine that microphone 122 is not located within an ear canal of a user, and that earbud 120 is therefore not located on or in an ear of a user. The results of this determination may be sent to decision module 540 for further processing.

Once an on ear decision has been generated by one of passive on ear detection module 510 and active on ear detection module 520 and passed to decision module 540, processor 124 may execute decision module 540 to determine whether any action needs to be performed as a result of the determination. According to some embodiments, decision module 540 may also store historical data of previous states of earbud 120 to assist in determining whether any action needs to be performed. For example, if the determination is that earbud 120 is now in an in-ear position, and previously stored data indicates that earbud 120 was previously in an out-of-ear position, decision module 540 may determine that audio should now be delivered to earbud 120.

Figure 6:
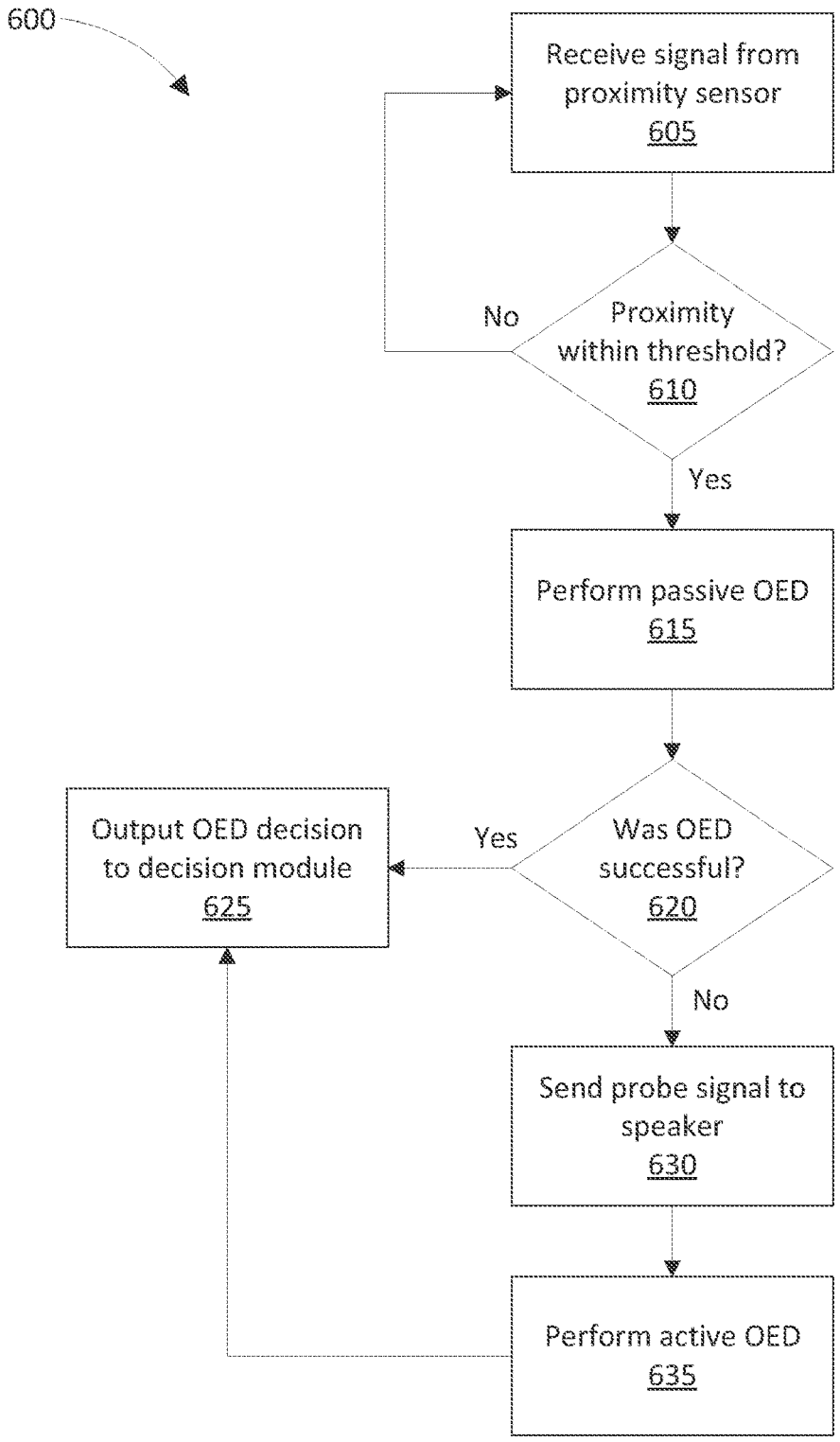
FIG. 6 shows a flowchart illustrating a method of determining whether or not a headset is in place on or in an ear of a user, as performed by the system of FIG. 1.

FIG. 6 is a flowchart illustrating a method 600 of on ear detection using earbud 120. Method 600 is performed by processor 124 executing code modules 510, 520, 530 and 540 stored in memory 125.

Method 600 starts at step 605, at which processor 124 receives a signal from proximity sensor 129. At step 610, processor 124 analyses the received signal to determine whether or not the signal indicates that earbud 120 is in proximity to an object. This analysis may include comparing the received signal to a predetermined threshold value, which may be a distance value in some embodiments. If processor 124 determines that the received signal indicates that earbud 120 is not in proximity to an object, processor 124 determines that earbud 120 cannot be located in or on an ear of a user, and so proceeds to wait for a further signal to be received from proximity sensor 129.

If, on the other hand, processor 124 determines from the signal received from proximity sensor 129 that earbud 120 is in proximity to an object, processor 124 continues to execute method 600 by proceeding to step 615. In embodiments where earbud 120 does not include a proximity sensor 129, steps 605 and 610 of method 600 may be skipped, and processor 124 may commence executing the method from step 615. According to some embodiments, a different sensor, such as a motion sensor, may be used to trigger the performance of method 600 from step 615.

At step 615, processor 124 executes passive on ear detection module 510 to determine whether earbud 120 is located in or on an ear of a user. As described in further detail above with references to FIGS. 3 and 4, executing passive on ear detection module 510 may comprise processor 124 receiving and comparing the power of passive signals $X_{RP}$ and $X_{EP}$ generated by microphones 121 and 122 in response to received ambient noise.

At step 620, processor 124 checks whether the passive on ear detection process was successful. If processor 124 was able to determine whether earbud 120 is located in or on an ear of a user based on passive signals $X_{RP}$ and $X_{EP}$, then at step 625 the result is output to decision module 540 for further processing. If processor 124 was unable to determine whether earbud 120 is located in or on an ear of a user based on passive signals $X_{RP}$ and $X_{EP}$, then processor 124 proceeds to execute an active on ear detection process by moving to step 630.

At step 630, processor 124 executes signal generation module 530 to cause a probe signal to be generated and sent to speaker 128 for emission. At step 635, processor 124 further executes active on ear detection module 520. As described in further detail above with references to FIG. 5, executing active on ear detection module 520 may comprise processor 124 receiving active signal $X_{EA}$ generated by microphone 122 in response to the emitted probe signal, and determining whether the received signal corresponds to resonance of the probe signal. According to some embodiments, executing active on ear detection module 520 may further comprise processor 124 receiving active signal $X_{RA}$ generated by microphone 121 in response to the emitted probe signal, and determining whether the received signal corresponds to resonance of the probe signal. At step 625, the result of the active on ear detection process is output to decision module 540 for further processing.

Figure 7A:
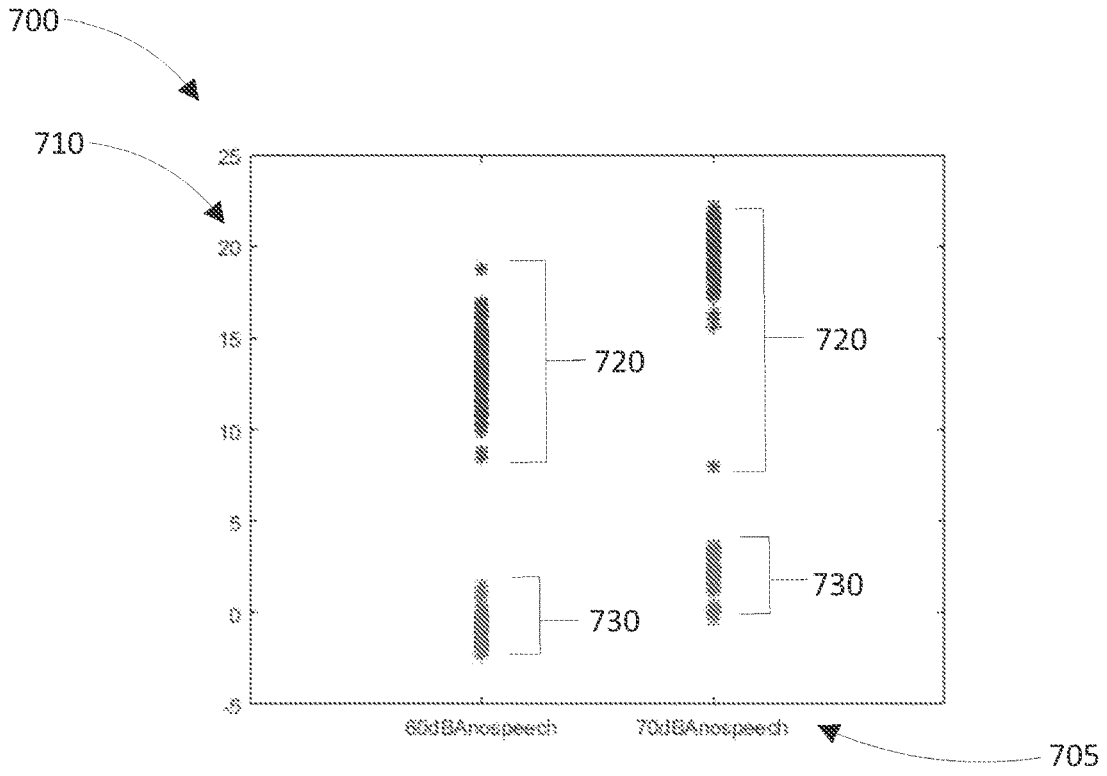
FIGS. 7A and 7B show graphs illustrating level differences measured by internal and external microphones according to some embodiments.
Figure 7B:
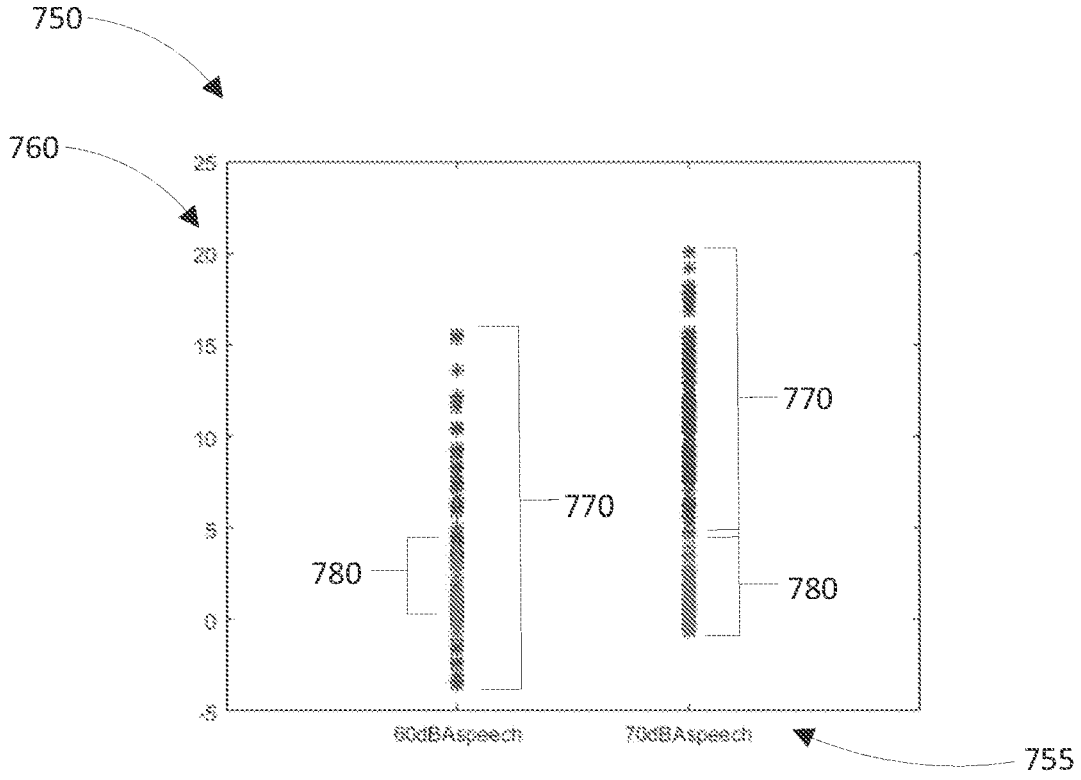

FIGS. 7A and 7B are graphs illustrating the level differences between signals measured by internal and external microphones.

FIG. 7A shows a graph 700 having an X-axis 705 and a Y-axis 710. X-axis 705 displays two conditions, being a 60 dBA ambient environment with no own speech and a 70 dBA environment with no speech. Y-axis 710 shows the level differences between signals recorded by reference microphone 121 and error microphone 122 in each environment.

Data points 720 relate to level differences for signals captured while earbud 120 was on or in an ear of a user, while data points 730 relate to level differences for signals captured while earbud 120 was off ear. As visible from graph 700, there is a significant gap between data points 720 and data points 730, indicating that calculating the level difference is an effective way to determine on ear status of earbud 120 in an environment with no own speech.

FIG. 7B shows a graph 750 having an X-axis 755 and a Y-axis 760. X-axis 755 displays two conditions, being a 60 dBA ambient environment with own speech and a 70 dBA environment with own speech. Y-axis 760 shows the level differences between signals recorded by reference microphone 121 and error microphone 122 in each environment.

Data points 770 relate to level differences for signals captured while earbud 120 was on or in an ear of a user, while data points 780 relate to level differences for signals captured while earbud 120 was off ear. As visible from graph 750, there is no longer a significant gap between data points 770 and data points 780, and instead these data points overlap, indicating that calculating the level difference is not always an effective way to determine on ear status of earbud 120 in an environment where own speech is present.

Figure 8A:
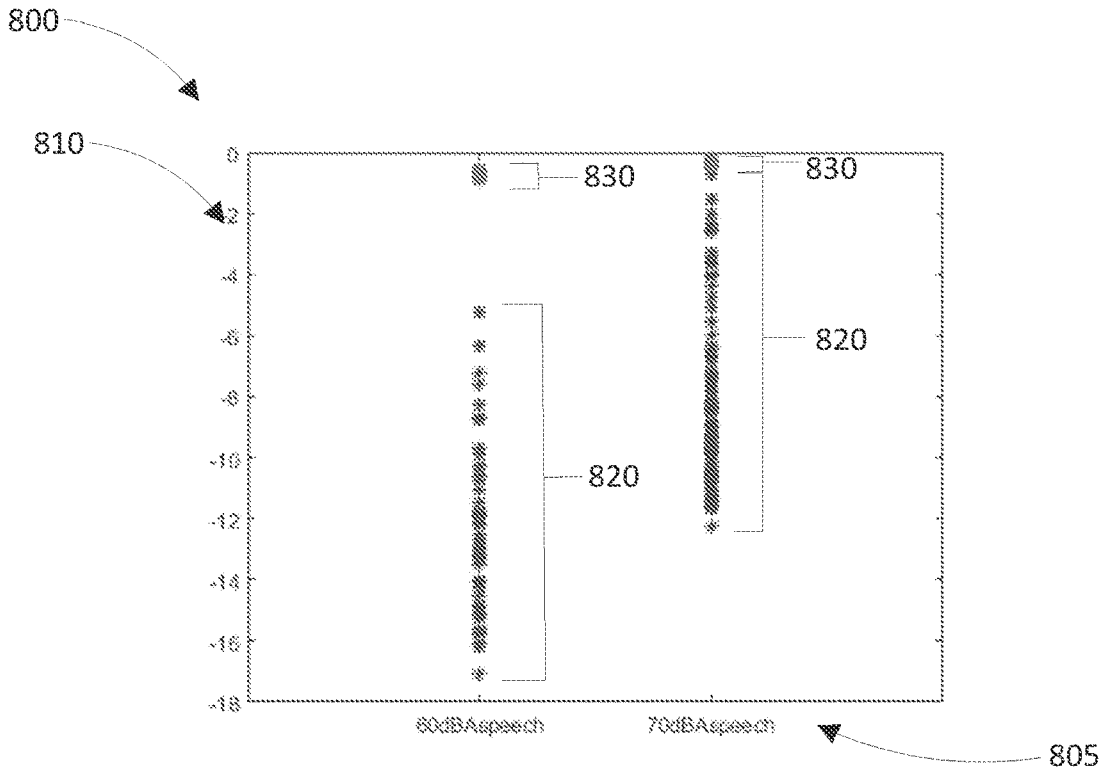
FIGS. 8A and 8B show graphs illustrating level differences of filtered signals measured by internal and external microphones according to some embodiments.
Figure 8B:
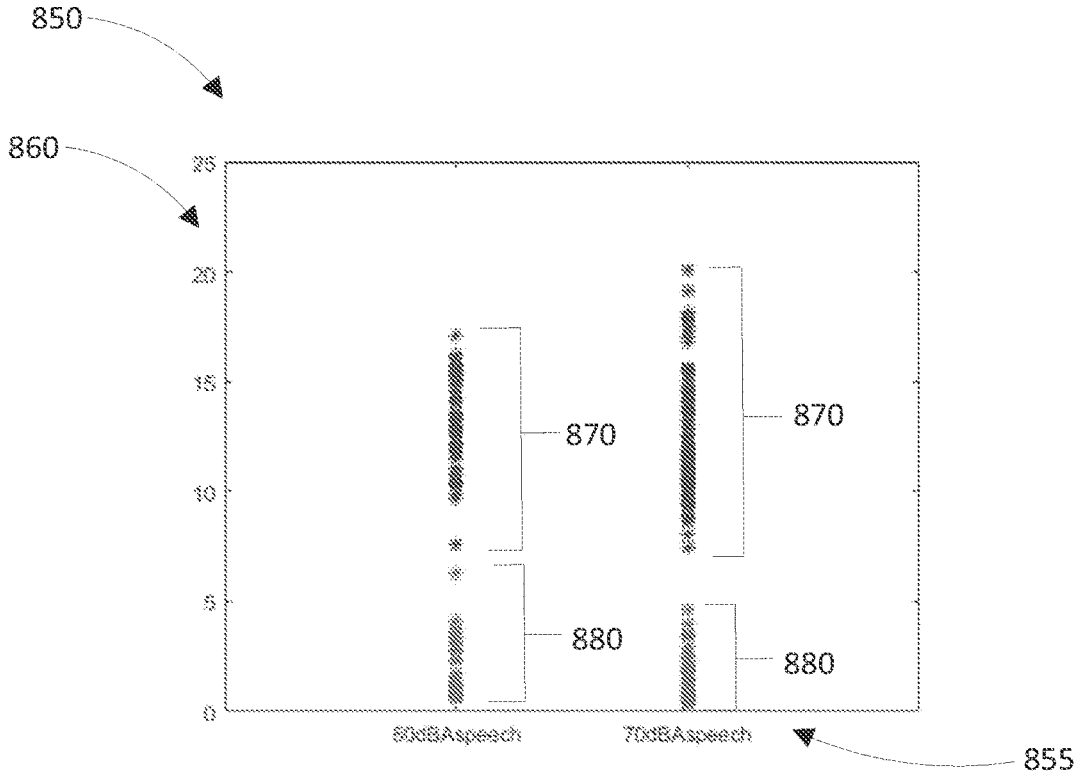

FIGS. 8A and 8B are graphs illustrating the level differences between signals measured by internal and external microphones, where those signals have been filtered and processed as described above with reference to FIGS. 3 and 4.

FIG. 8A shows a graph 800 having an X-axis 805 and a Y-axis 810. X-axis 805 displays two conditions, being a 60 dBA ambient environment with own speech and a 70 dBA environment with own speech. Y-axis 810 shows the level differences between signals recorded by reference microphone 121 and error microphone 122 and filtered by a 100 to 700 Hz band-pass filter in each environment.

Data points 820 relate to level differences for signals captured while earbud 120 was on or in an ear of a user, while data points 830 relate to level differences for signals captured while earbud 120 was off ear. As visible from graph 800, there is a significant gap between data points 820 and data points 830 for the 60 dBA environment and a small gap between data points 820 and data points 830 for the 70 dBA environment, with no overlap between data points 820 and 830. This indicates that calculating the level difference of filtered signals can be an effective way to determine on ear status of earbud 120 in an environment where own speech is present.

FIG. 8B shows a graph 850 having an X-axis 855 and a Y-axis 860. X-axis 855 displays two conditions, being a 60 dBA ambient environment with own speech and a 70 dBA environment with own speech. Y-axis 850 shows the level differences between signals recorded by reference microphone 121 and error microphone 122 and processed to combine level differences with the level differences filtered by a 100 to 700 Hz band-pass filter in each environment.

Specifically, graph 850 uses the larger of the level difference being the signal recorded by error microphone 122 subtracted from the signal recorded by reference microphone 121 filtered by a 2.8 to 4.7 kHz band-pass filter; and the level difference being the signal recorded by reference microphone 121 subtracted from the signal recorded by error microphone 122 filtered by a 100 to 700 Hz band-pass filter for each environment.

Data points 870 relate to level differences for signals captured while earbud 120 was on or in an ear of a user, while data points 880 relate to level differences for signals captured while earbud 120 was off ear. As visible from graph 850, there is a significant gap between data points 870 and data points 880, indicating that a combined metric including both level differences with and without own voice can be an effective way to determine on ear status of earbud 120 in an environment where own speech is present.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A signal processing device for on ear detection for a headset, the device comprising:

a first microphone input for receiving a microphone signal from a first microphone, the first microphone being configured to be positioned inside an ear of a user when the user is wearing the headset;

a second microphone input for receiving a microphone signal from a second microphone, the second microphone being configured to be positioned outside the ear of the user when the user is wearing the headset; and a processor configured to:

receive microphone signals from each of the first microphone input and the second microphone input;

pass the microphone signals through a first filter to remove low frequency components, producing first filtered microphone signals;

combine the first filtered microphone signals to determine a first on ear status metric;

pass the microphone signals comprising signals from each of the first microphone input and the second microphone input through a second filter to remove high frequency components, producing second filtered microphone signals;

combine the second filtered microphone signals to determine a second on ear status metric; and combine the first on ear status metric with the second on ear status metric to determine the on ear status of the headset.

2. The signal processing device of claim 1, wherein the first filter is configured to filter the microphone signals to retain only frequencies that are likely to correlate to bone conducted speech of the user of the headset.

3. The signal processing device of claim 2, wherein the second filter is configured to filter the microphone signals to retain only frequencies that are likely to resonate within the ear of the user.

4. The signal processing device of claim 3, wherein the first filter and the second filter are band pass filters.

5. The signal processing device of claim 1, wherein combining the first filtered signals comprises subtracting the first filtered signal derived from the microphone signal received from the second microphone from the first filtered signal derived from the microphone signal received from the first microphone.

6. The signal processing device of claim 1, wherein combining the second filtered signals comprises subtracting the second filtered signal derived from the microphone signal received from the first microphone from the second filtered signal derived from the microphone signal received from the second microphone.

7. The signal processing device of claim 1, wherein combining the first on ear status metric with the second on ear status metric comprises adding the metrics together, and comparing the result with a predetermined threshold.

8. A method of on ear detection for an earbud, the method comprising:

receiving microphone signals from each of a first microphone and a second microphone, wherein the first microphone is configured to be positioned inside an ear of a user when the user is wearing the earbud and the second microphone is configured to be positioned outside the ear of the user when the user is wearing the earbud;

passing the microphone signals through a first filter to remove low frequency components, producing first filtered microphone signals;

combining the first filtered microphone signals to determine a first on ear status value;

passing the microphone signals comprising signals from each of a first microphone input and a second microphone input through a second filter to remove high frequency components, producing second filtered microphone signals;

combining the second filtered microphone signals to determine a second on ear status value; and combining the first on ear status value with the second on ear status value to determine the on ear status of the headset.

9. The method of claim 8, wherein the first filter is configured to filter the microphone signals to retain only frequencies that are likely to correlate to bone conducted speech of the user of the headset.

10. The method of claim 9, wherein the second filter is configured to filter the microphone signals to retain only frequencies that are likely to resonate within the ear of the user.

11. The method of claim 10, wherein the first filter and the second filter are band pass filters.

12. The method of claim 8, wherein combining the first filtered signals comprises subtracting the first filtered signal derived from the microphone signal received from the second microphone from the first filtered signal derived from the microphone signal received from the first microphone.

13. The method of claim 8, wherein combining the second filtered signals comprises subtracting the second filtered signal derived from the microphone signal received from the first microphone from the second filtered signal derived from the microphone signal received from the second microphone.

14. The method of claim 8, wherein combining the first on ear status value with the second on ear status value comprises adding the values together to produce a passive OED metric, and comparing the passive OED metric with a predetermined threshold.

15. The method of claim 14, further comprising incrementing an on ear variable if the passive OED metric exceeds the threshold, and incrementing an off ear variable if the passive OED metric does not exceed the threshold.

16. The method of claim 15, further comprising determining that the status of the earbud is on ear if the on ear variable value is larger than a first predetermined threshold and the off ear variable value is smaller than a second predetermined threshold; determining that the status of the earbud is off ear if the off ear variable value is larger than the first predetermined threshold and the on ear variable value is smaller than the second predetermined threshold; and otherwise determining that the status of the earbud is unknown.

17. The method of claim 8, further comprising determining whether the microphone signals correspond to valid data, by comparing the power level of the microphone signals received from the second microphone exceed a predetermined threshold.

18. A non-transitory machine-readable medium storing instructions which, when executed by one or more processors, cause an electronic apparatus to perform the method of claim 8.

19. An apparatus, comprising processing circuitry and a non-transitory machine-readable which, when executed by the processing circuitry, cause the apparatus to perform the method of claim 8.

20. A system for on ear detection for an earbud, the system comprising a processor and a memory, the memory containing instructions executable by the processor and wherein the system is operative to perform the method of claim 8.

* * * * *